US008145115B2

(12) United States Patent
Yamanouchi et al.

(10) Patent No.: US 8,145,115 B2
(45) Date of Patent: Mar. 27, 2012

(54) IMAGE FORMATION METHOD

(75) Inventors: Takao Yamanouchi, Kanagawa (JP); Kazue Nakamura, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 152 days.

(21) Appl. No.: 12/797,817

(22) Filed: Jun. 10, 2010

(65) Prior Publication Data

US 2010/0322685 A1 Dec. 23, 2010

(30) Foreign Application Priority Data

Jun. 18, 2009 (JP) ..... 2009-145120

(51) Int. Cl.
*G03G 15/20* (2006.01)

(52) U.S. Cl. ..... 399/342

(58) Field of Classification Search ..... 399/342, 399/341, 58; 430/97
See application file for complete search history.

(56) References Cited

U.S. PATENT DOCUMENTS

2009/0016757 A1* 1/2009 Priebe et al. ..... 399/58
2009/0186289 A1* 7/2009 Nakamura et al. ..... 430/108.4

FOREIGN PATENT DOCUMENTS

JP 200793699 4/2007
JP 2008532066 8/2008

* cited by examiner

*Primary Examiner* — Kiho Kim
(74) *Attorney, Agent, or Firm* — Lucas & Mercanti, LLP

(57) ABSTRACT

Disclosed is an image formation method in which clear dots comprised of clear toner are formed on an image with a 75° glossiness of from 10 to 60, the image formation method comprising the steps of forming a clear toner image on the image, employing clear toner, and fixing the clear toner image by non-contact heat fixation to form clear dots in the form of protrusions, wherein the clear dots have an average height H and an average circle equivalent diameter R, a ratio H/R of the average height H to the average circle equivalent diameter R satisfying the following inequality:

$$0.005 \leq H/R \leq 10.$$

11 Claims, 1 Drawing Sheet

IMAGE FORMATION METHOD

This application is based on Japanese Patent Application No. 2009-145120, filed on Jun. 18, 2009 in Japanese Patent Office, the entire content of which is hereby incorporated by reference.

FIELD OF THE INVENTION

The present invention relates to an image formation method of forming an image given a stereoscopic effect.

TECHNICAL BACKGROUND

Conventionally, as a method of forming an image given a stereoscopic effect in the commercial printing field, there is, for example, a so-called barco printing method which increases a thickness of a printed ink layer or of a transparent varnish layer in an image to form a rugged printed image, thereby giving a stereoscopic effect to the printed image. Particularly, a thick transparent varnish layer exhibits a lens effect to an image of an under layer, whereby a good stereoscopic effect is given to the image.

Further, there has been realized a so-called lenticular printing method in which a semicircular convex lens sheet is laminated on an image to give a 3D effect to the image.

In recent years, in the commercial printing field, a POD (print on demand) apparatus according to an electrophotographic process, which can provide a small volume of prints according to a plateless printing process at a short period and at low cost, has been widely applied. It is required also in such a POD apparatus to realize an image with a stereoscopic appearance. In order to meet such a requirement, there is proposed, for example, a technique which forms a stereo image by forming a texture pattern on an image employing clear toner (see, for example, Japanese Patent O.P.I. Publication No. 2008-532066).

Further, there is proposed a technique which expands a toner image formed employing toner containing a foaming agent. As a technique to apply such a technique, there is a technique disclosed for example in Japanese Patent O.P.I. Publication No. 2007-93699 in which a stereo image is formed employing clear toner or white toner. Furthermore, there is proposed a method disclosed on the Internet (searched on Apr. 1, 2009)<URL: http://japan.zdnet.com/news/hardware/story/0,2000056184,20350441,00.htm> in which a stereo image is formed by adding a foaming agent to an image support medium itself.

However, the methods described above do not give a sufficient stereoscopic effect to an image, although they can form a thick and stereoscopic clear toner layer. For example, in a method of utilizing a texture pattern, a clear toner for forming the texture pattern is expanded by application of pressure and heat due to contact heating. In a method of utilizing a clear toner containing a foaming agent, clearness of an image is lowered by a gas bubble generated within the clear toner. In a method of utilizing an image support medium containing a foaming agent, the image support medium itself elevates, but a toner image does not take a stereoscopic structure, and therefore a stereoscopic effect cannot be given to the image.

SUMMARY OF THE INVENTION

The present invention has been made in view of the above. An object of the invention is to provide an image formation method capable of forming an image to which a stereoscopic effect is given. The image formation method of the invention is an image formation method in which clear dots comprised of clear toner are formed on an image with a 75° glossiness of from 10 to 60, the image formation method comprising the steps of forming a clear toner image on the image, employing clear toner, and fixing the clear toner image by non-contact heat fixation to form clear dots in the form of protrusions, wherein the clear dots have an average height H and an average circle equivalent diameter R, a ratio H/R of the average height H to the average circle equivalent diameter R satisfying the following inequality:

$$0.005 \leqq H/R \leqq 10$$

DETAILED DESCRIPTION OF THE INVENTION

The image formation method of the invention is characterized in an image formation method in which clear dots comprised of clear toner are formed on an image with a 75° glossiness of from 10 to 60, the image formation method comprising the steps of forming a clear toner image on the image, employing clear toner, and fixing the clear toner image by non-contact heat fixation to form clear dots in the form of protrusions, wherein the clear dots have an average height H and an average circle equivalent diameter R, a ratio H/R of the average height H to the average circle equivalent diameter R satisfying the following inequality:

$$0.005 \leqq H/R \leqq 10$$

In the image formation method of the invention, the average circle equivalent diameter R of the dots is preferably from 10 μm to 2 mm.

In the image formation method of the invention, the average height H of the dots is preferably from 10 to 100 μm.

In the image formation method of the invention, the non-contact heat fixation for forming the clear dots above is preferably a flash fixation.

In this image formation layer, it is preferred that the clear toner for forming the clear dots is composed of clear toner particles preferably containing an infrared absorbent.

The image formation method of the present invention can provide a printed matter having an image to which a stereoscopic effect is given, since clear dots having specific protrusions are formed on the image. It is presumed that the reason that an image on which the clear dots having the specific protrusions are formed is stereoscopically viewed is because the clear dots exhibit a lens effect.

Next, the present invention will be explained in detail.

Figure 1:
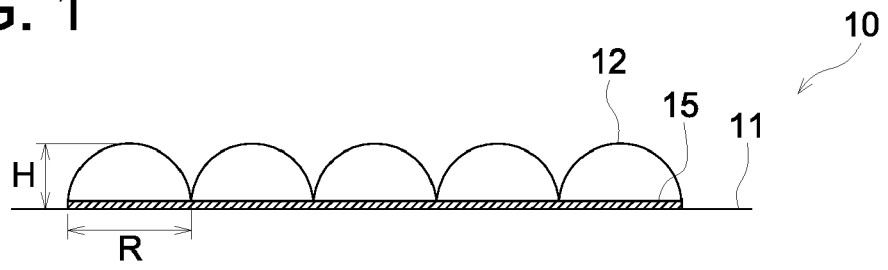
FIG. 1 is a sectional view showing one embodiment of printed matter obtained according to the image formation method of the invention.

As is shown in FIG. 1, the image formation method of the invention is a method, in which clear dots 12 composed of clear toner are formed on an image 15 having a 75° glossiness of from 10 to 60 on an image support medium 11 according to a non-contact heat fixation, thereby obtaining a printed matter 10.

The clear dots 12 are substantially colorless and transparent small blocks in the form of protrusion formed of the clear toner, and have a ratio H/R of an average height H to an average circle equivalent diameter R (hereinafter also referred to as a degree of protrusion H/R), the ratio H/R satisfying the following inequality:

$$0.005 \leqq H/R \leqq 10$$

The image 15, which is an image object formed according to the image formation method of the invention and viewed stereoscopically and which has a 75° glossiness falling within the above described range, that is, a 75° glossiness falling within the so-called mat to semi-gloss range, is given a sufficient stereoscopic effect by the lens effect of the clear dots 12 having a degree of protrusion H/R falling within the above described range. An image having a 75° glossiness of less than 10, is one with too a rough image surface, resulting in impossibility of forming good clear dots on the image surface. Therefore, such an image in printed matter may cause problem in that a stereoscopic effect is not sufficiently given to the image. Since an image having a 75° glossiness exceeding 60 is one with too a high glossiness, it may cause problem in that clear dots formed are difficult to be given a stereoscopic effect to the image.

The image having a 75° glossiness of from 10 to 60 is preferably formed employing an electrophotographic process. The image having a 75° glossiness of from 10 to 60 can be obtained, for example, by forming an unfixed image formed employing an electrophotographic process and fixing the image under fixing conditions such as fixing temperature which are selected so as to give an image having a 75° glossiness of from 10 to 60.

Glossiness of the image 15 is measured by a glossimeter GMX-203 (manufactured by Murakami Color Research Laboratory Co., Ltd.), selecting a measuring angle in accordance with JIS Z 8741. Herein, 75° glossinesses at five points, the four corners and center of the image 15 are measured, and the arithmetic average thereof is determined as the 75° glossiness of the image 15.

The clear dots 12 in the printed matter 10 having a degree of protrusion H/R falling within the range described above exhibits an appropriate lens effect and gives a stereoscopic effect to the image 15. In contrast, clear dots having a degree of protrusion H/R of less than 0.005 is ones with too a low curvature, and may cause problem in that a satisfactory lens effect cannot be obtained. Alternatively, clear dots having a degree of protrusion H/R exceeding 10 may cause problem in that they lower visibility of an image on which the clear dots are formed, since the image visibility greatly varies due to small change of a viewing angle.

The average circle equivalent diameter R of the clear dots 12 in the printed matter 10 is preferably from 10 μm to 2 mm.

In the invention, the average circle equivalent diameter R of the clear dots 12 in the printed matter 10 is an arithmetic average of the circle equivalent diameters of 100 of the clear dots 12 measured according to the following procedure. The printed matter 10 is photographed by a factor of 100, and the arithmetic average of the circle equivalent diameters of 100 of the clear dots 12 in the resulting photographic image is measured employing an image processing analysis apparatus LUZEX III (manufactured by NIRECO Corp.).

The average height H of the clear dots 12 in the printed matter 10 is preferably from 10 to 100 μm.

In the invention, the average height H of the clear dots 12 in the printed matter 10 is an arithmetic average of the heights of 100 of the clear dots 12 measured according to the following procedure. The printed matter 10 is observed by a factor of 1,000 employing a color 3D laser scanning microscope VK-9700 (manufactured by KEYENCE Corp.) and the heights of 100 of the clear dots 12 are measured employing the microscope, and the arithmetic average thereof is determined as the average height H of the clear dots 12. Herein, the height is a distance between the surface of the image support medium 11 and the peak of each of the clear dots 12.

In the image formation method of the invention, it is sufficient if one or more of the clear dots 12 are formed on the image 15 of the printed matter 10. It is preferred that the clear dots 12 are regularly disposed so as to cover at least the entire surface of the image 15. The clear dots 12 may be regularly disposed so as to cover the entire surface on the image side of the printed matter 10.

Figure 2:
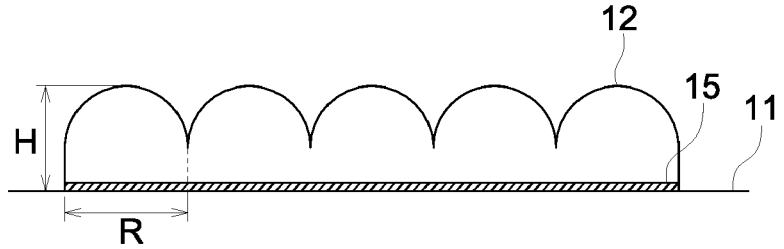
FIG. 2 is a sectional view showing another embodiment of printed matter obtained according to the image formation method of the invention.

As shown in FIG. 2, clear dots adjacent to each other of the clear dots 12 formed on the image 15 in the printed matter 10 may be in contact with each other at a position distant from the surface of the image support medium 11. In this case, the degree of protrusion H/R of the clear dots 12 can be determined from the circle equivalent diameter of the projected images on the image support medium 11 of an assembly of the points at which the adjacent clear dots contact each other.

In the invention, the clear dots 12 are preferably found employing an electrophotographic process.

[Fixing Method]

As a fixing method according to a non-contact heating method for forming clear dots 12, there is, for example, a method according to flash fixation. In the clear dot formation method employing the flash fixation, clear toner is used which contains an infrared absorbent absorbing light with a wavelength in an infrared region to generate heat.

Figure 3:
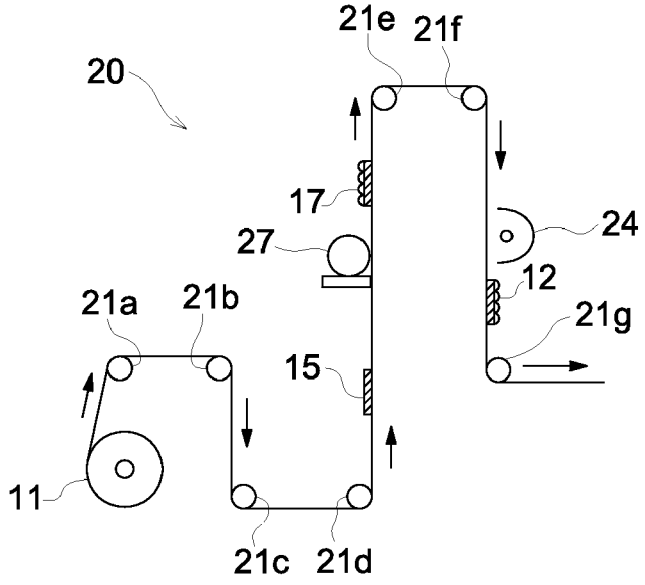
FIG. 3 is a schematic view showing one embodiment of the structure of a clear dot formation apparatus used in the image formation method of the invention.

As a clear dot formation apparatus employing such a flash fixation, there is, for example, a clear dot formation apparatus 20 as is shown in FIG. 3.

The clear dot formation apparatus 20 comprises a clear dot formation device 27, a flash fixation device 24, and transport rollers 21*a*, 21*b*, 21*c*, 21*d*, 21*e*, 21*f* and 21*g*. The clear dot formation device 27, which rotates in the opposite direction from the transporting direction of an image support medium 11 as shown in an arrow in FIG. 3, transfers a clear toner image formed by development of an electrostatic image with clear toner according to an electrophotographic process to one surface of the image support medium 11, one end of which is wound in the roll form, the flash fixation device 24 irradiates infrared light employing a flash lamp such as xenon lamp, and the transport rollers 21*a* through 21*g* transport the image support medium 11.

In the clear dot formation apparatus 20, a clear toner image, which has been formed on the clear dot formation device 27, is transferred onto the image support medium 11 with an image 15, which is transported in a timely manner, whereby an unfixed clear toner image 16 is formed, and irradiated with an infrared light through the flash fixation device 24, whereby the clear toner of the unfixed clear toner image 16 softens and melts to be firmly fixed on the image 15 or onto both image 15 and the image support medium 11, forming clear dots 12. Thus, a printed matter 10, which is the final printed product, is obtained.

The image 15, which has been formed on an image support medium 11 and onto which a clear toner image is to be transferred, may be an unfixed one, but it is preferred that the image 15 is a fixed one which has been fixed employing an appropriate fixation device, for example, a contact heating fixation device, in giving firm fixation to the visible image of the printed matter 11.

The irradiation quantity of infrared light to be irradiated from the flash fixation device 24 varies due to physical properties of clear toner used, specifically kind or addition amount of an infrared absorbent contained in the clear toner particles or kind of the components constituting the clear toner particles. The infrared light irradiation quantity is preferably a quantity such that the emission energy of a flash fixation device such as a flash lamp is from 1 to 10 J/cm$^2$.

The infrared light irradiation quantity according to the flash fixation device 24 is preferably minimum among infrared light irradiation quantities at which melt adhesion between the image 15 and the bottom portions contacting the image 15 of the clear dots 12 and melt adhesion between clear dots 12 adjacent to each other are secured, since a sufficient height of the clear dots 12 can be obtained by lowering the melt degree of the clear toner particles.

With regard to the shape of the clear toner image which is developed and transferred employing the clear dot formation device 27, the two dimensional shape of the bottom of the clear dots of the clear toner image, the bottom contacting the image surface, may be circular, polygonal or amorphous. The height H of the clear dots 12, which are melt and formed according to the flash fixation device 24, can be set to be an appropriate amplitude compared to the circle equivalent diameter R of the clear dots 12.

The two dimensional shape of the clear dot bottom, which contacts the surface of the image 15, can be determined by a latent image pattern written by a laser or an LED, and the height H of each of the clear dots at the clear toner image can be determined by the output power of the laser or by developing condition such as DC/AC bias.

(Clear Toner)

The clear toner used in the image formation method of forming an image with clear dots 12 employing the clear dot formation apparatus 20 as described above is composed of substantially colorless and transparent clear toner particles containing an infrared absorbent.

The substantially colorless and transparent clear toner particles herein referred to are those which do not contain colorants such as colored pigments, colored dyes, black carbon particles and black magnetic powders which scatter or absorb light to exhibit coloration. Clear toner particles may be somewhat low in transparency, depending on the type or addition amount of the clear toner constituents constituting the clear toner particles.

The clear toner particles contain both a binder resin having transparency (hereinafter also referred to as a transparent resin) and an infrared absorbent, and optionally contain a charge controlling agent or wax.

[Infrared Absorbent]

The infrared absorbent to be contained in the clear toner particles may be dispersed inside the toner particles, or may be added to the toner particles as a so-called external additive to adhere to the particle surface. When the infrared absorbent is dispersed inside the clear toner particles, the number average primary particle diameter of the infrared absorbent is preferably from 60 to 1000 nm, and more preferably from 80 to 500 nm.

As the infrared absorbent, there can be used various known infrared absorbent. For example, a cyanine compound, a merocyanine compound, a benzene thiol metal complex, a mercaptophenol metal complex, an aromatic diamine metal complex, a diimmonium compound, an aminium compound, a nickel complex, a phthalocyanine compound, an anthraquinone compound, an anthraquinone compound, and naphthalocyanine compound can be used.

As typical examples thereof, there can be used a metal complex infrared absorbent (SIR-130, SIR-132, each manufactured by Mitsui Chemicals, Inc.), bis(dithiobenzyl)nickel (MIR-101, manufactured by Midori Kagaku Co., Ltd.), bis[1,2-bis(p-methoxyphenyl)-1,2-ethylenedithiolate]nickel (MIR-102, manufactured by Midori Kagaku Co., Ltd.), tetra-N-butylammoniumbis(cis-1,2-diphenyl-1,2-ethylenedithiolate)nickel (MIR-1011, manufactured by Midori Kagaku Co., Ltd.), tetra-N-butylammoniumbis[1,2-bis(p-methoxyphenyl)-1,2-ethylenedithiolate]nickel (MIR-1021, manufactured by Midori Kagaku Co., Ltd.), bis[4-tert-1,2-butyl-1,2-dithiophenolate]nickel-tetra-N-butylammonium (BBDT-NI, manufactured by Sumitomo Chemical Co., Ltd.), a cyanine infrared absorbent (IRF-106, IRF-107, each manufactured by Fuji Photo Film Co., Ltd.), an inorganic salt infrared absorbent (NIR-AM1, manufactured by Teikoku Chemical Industry, Co., Ltd.), an immonium compound (CIR-1080, CIR-1081, manufactured by Japan Carlit Co., Ltd.), an aminium compound (CIR-960, CIR-961, manufactured by Japan Carlit Co., Ltd.), an anthraquinone compound (manufactured by IR-750, manufactured by Nippon Kayaku Co., Ltd.), an aminium compound (IRG-2, IRG-3, each manufactured by Nippon Kayaku Co., Ltd.), a polymethine compound (IR-820B, manufactured by Nippon Kayaku Co., Ltd.), a diimonium compound (IRG-022, IRG-023, each manufactured by Nippon Kayaku Co., Ltd.), a cyanine compound (CY-2, CY-4, CY-9, each manufactured by Nippon Kayaku Co., Ltd.), and a soluble phthalocyanine (TX-305, manufactured by Nippon Shokubai Co., Ltd.). In order to secure transparency, the dithiol-nickel complexes among these are preferred which have high infrared absorption and are light-colored.

A method for incorporating the aforementioned infrared absorbent into the clear toner particles is not specifically limited. For example, in a clear toner manufacturing method according to an emulsion polymerization aggregation method described later, there is (1) a method in which a dispersion, containing a mixture of transparent resin particles and infrared absorbent particles each dispersed at the molecular level, is prepared, and then both particles are allowed to aggregate in the dispersion, thereby obtaining clear toner particles, or (2) a method in which a dispersion containing resin particles and a dispersion containing only infrared absorbent particles, which are prepared separately, are mixed and then both particles are allowed to aggregate in the resulting mixed dispersion, thereby obtaining clear toner particles.

The mixture of transparent resin particles and infrared absorbent particles each dispersed at the molecular level can be prepared according to a method of polymerizing a monomer solution, in which an infrared absorbent is dissolved in a polymerizable monomer for the transparent resin.

The infrared absorbent content of the clear toner particles is preferably from 0.1 to 3% by weight, and more preferably from 0.5 to 3% by weight. The above content of the infrared absorbent in the clear toner particles enables the infrared absorbent to melt effectively while maintaining high transparency of the clear toner particles. When the infrared absorbent content of the clear toner particles is less than 0.1% by weight, there may occur a problem that the clear toner particles are not sufficiently melted, resulting in insufficient fixation of the clear toner dots, while when the infrared absorbent content of the clear toner particles exceeds 3% by weight, there may occur a problem that transparency of the clear dots is low, lowering coloration of an image formed.

As a transparent resin constituting the clear toner particles, there are mentioned vinyl resins such as a styrene resin, a (meth)acryl resin, a styrene-(meth)acryl copolymer and a polyolefin resin; known various thermoplastic resin such as a polyester resin, a polyamide resin, a polycarbonate resin, a polyether, polyvinyl acetate resin, a polysulfone resin and a polyurethane resin; and heat curable resins such as an epoxy resin and the like. Particularly, a styrene resin, an acryl resin or a polyester resin is preferred which has high transparency, low melt viscosity and high sharply melting property. These infrared absorbents may be used singly or as an admixture of two or more kinds thereof.

[Wax]

The clear toner particles constituting the clear toner of the invention may contain wax in addition to the transparent resin and the infrared absorbent, although the particles do not ordinarily contain the wax. The wax is not specifically limited, but examples thereof include paraffin and long chained alkyl esters. As a method of incorporating the wax into the clear toner particles, there is mentioned the same as the method of incorporating the infrared absorbent into the clear toner particles.

The content of the wax in the clear toner particles is preferably not more than 5 parts by weight, and more preferably not more than 3 parts by weight, based on 100 parts by weight of the transparent resin. Too large content of the wax in the clear toner particles lowers transparency of the clear toner particles.

[Charge Controlling Agent]

The clear toner particles constituting the clear toner of the invention optionally contains a charge controlling agent in addition to the transparent resin and the infrared absorbent, although the particles do not contain the charge controlling agent. The charge controlling agent is not specifically limited, and known various compounds can be used.

As a method of incorporating the charge controlling agent into the clear toner particles, there is mentioned the same as the method of incorporating the infrared absorbent into the clear toner particles.

The content of the charge controlling agent in the clear toner particles is preferably not more than 5 parts by weight, and more preferably not more than 3 parts by weight, based on 100 parts by weight of the transparent resin. Too large content of the charge controlling agent in the clear toner particles lowers transparency of the clear toner.

The clear toner used in the invention has a softening point of preferably from 80 to 120° C., and more preferably from 90 to 110° C. The melting point range described above is preferred, since it provides a high transparency of the clear toner, a high color density in a formed color image, and a sufficient height of the clear dots.

Softening point of the clear toner herein refers to that which is determined as follows. Clear toner of 1.1 g is placed in a Petri dish at a temperature of 20° C. and at a relative humidity of 50%, flattened out, and allowed to stand for at least 12 hours. Thereafter, a 1 cm diameter cylindrical molded sample is prepared via application of a pressure of 3,820 kg/cm$^2$, employing a molding machine "SSP-10A" (produced by Shimadzu Corp.). Subsequently, the resulting sample was measured under a temperature of 24° C. and a relative humidity of 50%, employing a flow tester "CFT-500D" (produced by Shimadzu Corp.). The resulting sample is extruded from a cylindrical die hole (1 mm diameter×1 mm) employing a 1 cm diameter piston after 300 second pre-heating under conditions of an applied load of 196 N (20 kgf), an initial temperature of 60° C., and a temperature raising rate of 6° C./minute, and offset method temperature $T_{offset}$ which is determined based on the fusion temperature determination method according to the temperature raising method, which is set at an offset value of 5 mm, is designated as the softening point of the clear toner.

The clear toner in the invention has a number average molecular weight (Mn) of preferably from 3,000 to 6,000, and more preferably from 3,500 to 5,500, a ratio Mw/Mn of a weight average molecular weight (Mw) to a number average molecular weight (Mn) of preferably from 2.0 to 6.0, and more preferably from 2.5 to 5.5, and a glass transition point of preferably from 30 to 60° C., and more preferably from 35 to 50° C.

The molecular weight of the clear toner is measured according to GPC. Using an apparatus HLC-8220 (produced by TOSOH CORP.) and a column TSK guard column+TSK gel Super HZM-M3 (produced by TOSOH CORP.), THF as a carrier solvent is fed at a flow rate of 0.2 ml/min, while maintaining a column temperature of 40° C. A sample (clear toner) is dissolved in THF at room temperature so as to have a concentration of 1 mg/ml, while dispersing for 5 min. by using an ultrasonic dispersing machine and then filtered by a membrane filter with a 0.2 μm pore size to obtain a sample solution. Then, 10 μl of this sample solution is injected with a carrier gas into the GPC and is detected by a refractive index detector (RI detector). In the molecular weight measurement of a sample, the molecular weight distribution of the sample is calculated using a calibration curve prepared by using monodisperse polystyrene standard particles. In the invention, ten standard polystyrenes having different molecular weight are used for the calibration curve.

Further, the glass transition temperature (Tg) of the clear toner is determined employing a differential scanning calorimeter "DSC-7" (also produced by Perkin-Elmer), and a thermal analyzer controller "TAC7/DX" (produced by Perkin-Elmer). The measurement of the glass transition temperature (Tg) is conducted as follows. Clear toner of 4.5 mg is precisely weighed, sealed into an aluminum pan (KIT NO. 0219-0041) and set into a DSC-7 sample holder. An empty aluminum pan is used as a reference. The temperature was controlled through a mode of heat-cool-heat at a temperature-raising rate of 10° C./min. and a temperature-lowering rate of 10° C./min. in the range of 0 to 200° C. Data are recorded during the second heating, and an extension line from the base-line prior to the initial rise of the first endothermic peak and a tangent line exhibiting the maximum slope between the initial rise and the peak are drawn and the intersection of both lines is defined as the glass transition point (Tg). At the first heating, the temperature is maintained at 200° C. for 5 minutes.

[Manufacturing Method of Clear Toner]

As methods to manufacture the clear toner used in the image formation method of the present invention, there are mentioned a kneading-pulverizing method, a suspension polymerization method, an emulsion polymerization method, an emulsion polymerization aggregation method, a mini-emulsion polymerization aggregation method, and an encapsulation method, as well as other known methods. A method to manufacture clear toner is preferably an emulsion polymerization aggregation method in view of production cost and production stability.

In the emulsion polymerization aggregation method, a dispersion of transparent resin particles to be contained in clear toner, which has been produced by an emulsion polymerization method, is optionally blended with a dispersion of wax particles, and the dispersion is subjected to slow aggregation, which is carried out while balancing the repulsive forces of particle surfaces due to pH control and aggregating forces generated due to addition of coagulants composed of electrolytes, wherein association is carried out while controlling the average particle diameter and the particle size distribution, and at the same time heating and stirring is carried out to cause fusion among particles and control the particle shape. Thus, clear toner particles are prepared.

When the emulsion polymerization aggregation method is employed as a method to produce clear toner, the resulting particles may be comprised of at least two layers containing resins differing in composition. In such a case, it is possible to employ a method in which polymerization initiators and polymerizable monomers are added to a first resin particle dispersion prepared by an emulsion polymerization processing (a first stage polymerization) based on an ordinary method, and the resulting mixture is subjected to additional polymerization processing (a second stage polymerization).

[Particle Diameter of Clear Toner Particles]

The particle diameter (in terms of volume based median diameter) of the clear toner particles used in the image formation method of the invention is preferably from 4 to 10 μm, and more preferably from 6 to 9 μm. The toner particle diameter can be controlled via the concentration and added amount of a coagulant (salting agent) used, timing of addition of an aggregation-terminating agent, temperature during aggregation or the composition of the polymer to be obtained.

The volume based median diameter of the clear toner is determined and calculated employing a measuring device in which a data processing computer system (produced by Beckmann-Coulter Co.) is connected to "COULTER MULTISIZER TA-III". For example, 0.02 g of clear toner is added to 20 ml of a surface active agent solution (a surface active agent solution which is prepared by diluting a neutral detergent containing surface active agent components with purified water by a factor of 10 for the purpose of dispersing the clear toner). After sufficient blending, ultrasonic dispersion is carried out over one minute to obtain a clear toner dispersion. The resulting clear toner dispersion is injected, employing a pipette, into a beaker on the sample stand, in which electrolyte "ISOTON II" (produced by Beckmann-Coulter Co.) is incorporated, until the displayed concentration of the measuring device reaches 5 to 10%. The above concentration provides reproducible measured values. The above measuring device is set at a measuring particle account number of 25,000 and an aperture diameter of 50 μm. The measurement diameter range of from 1 to 30 μm being divided into 256 diameters, frequency at each diameter was determined and the 50% volume cumulative diameter from the larger value is designated as the volume based median diameter.

[Average Degree of Circularity of Clear Toner Particles]

With regard to the clear toner used in the image formation method of the invention, the toner particles constituting the clear toner have an average degree of circularity of preferably from 0.930 to 1.000, and more preferably from 0.950 to 0.995 in view of improvement of transfer efficiency. Herein, the average degree of circularity of the clear toner particles refers to an average of the degree of circularity of arbitrarily selected 100 clear toner particles, and the degree of circularity of an individual clear toner particle is represented by the following formula (T):

Degree of Circularity of Clear Toner Particles=Peripheral Length of Circle obtained from Circle Equivalent Diameter of Particle Projection Image/Peripheral Length of Particle Projection Image — Formula (T)

The average degree of circularity of the clear toner particles is measured through FPIA 2100 (produced by SISMECS Co. Ltd.).

[External Additives]

The clear toner particles described above alone can constitute the clear toner used in the image formation method of the invention. However, in order to improve fluidity, charging properties, cleaning properties and the like, the clear toner of the invention may be obtained by adding to the clear toner particles a so-called external additive as a post-processing agent such as a fluidizing agent or a cleaning aid.

As the post-processing agents, there are mentioned inorganic oxide particles such as silica particles, alumina particles and titanium oxide particles; inorganic stearic acid compound particles such as aluminum stearate particles and zinc stearate particles; and inorganic titanic acid compound particles such as strontium titanate particles and zinc titanate particles. These may be used alone or as an admixture of two or more kinds thereof.

These inorganic particles are preferably surface treated with a silane coupling agent, a titanium coupling agent, a higher fatty acid, or silicone oil in order to improve environmental stability or heat-resistant storage stability.

The content of these external additives in the clear toner is from 0.05 to 5 parts by weight, and preferably from 0.1 to 3 parts by weight, based on 100 parts by weight of clear toner. Further, the external additives may be employed as an admixture of two or more kinds thereof.

The clear toner used in the image formation method of the invention may be employed as a magnetic or non-magnetic single component developer, but may also be employed as a double component developer after being blended with carriers. When the clear toner used in the invention is employed as a double component developer, magnetic particles are usable as a carrier, which are composed of the materials known in the art such as a metal of iron, ferrite or magnetite, as well as an alloy of the above metal with aluminum or lead. Of these, ferrite particles are particularly preferred. Further, employed as a carrier may be a coated carrier prepared by coating the surface of magnetic particles with a covering agent such as a resin, and a binder type carrier prepared by dispersing magnetic powder in a binder resin.

The covering resin constituting the coated carrier is not particularly limited, and examples thereof include olefin resins, styrene resins, styrene-acryl resins, silicone resins, polyesters and fluorine-containing resins. Further, a resin constituting a resin dispersion type carrier is not particularly limited, and conventional ones can be used. Examples thereof include an olefin resin, a styrene resin, a styrene-acryl resin, an ester resin, a fluorine-containing resin and a phenol resin.

The volume based median diameter of the carrier is preferably from 20 to 100 μm, and more preferably from 20 to 60 μm. The volume based median diameter of the carrier is determined, employing a laser diffraction type particle size distribution meter "HELOS" (produced by SYMPATEC Co.) as a representative meter.

[Image Support Medium]

As the image support medium used in the image formation method of the invention, there are mentioned various kinds of image support media, for example, plain paper from thin paper to heavy paper; a fine-quality paper; coated paper for printing such as art paper or coated paper; commercially available Japanese paper and post-card paper; OHP plastic film; and fabric, but the invention is not limited thereto.

[Image]

In the image formation method of the invention, an image to be given a stereoscopic effect is not specifically limited, as long as it has a 75° glossiness of 10 to 60, and can be obtained according to conventional various methods.

According to the image formation method of the invention, the clear dots having a specific protrusion shape are formed on the image having a 75° glossiness of 10 to 60, whereby the printed matter having an image given a stereoscopic effect can be obtained.

The reason that the image on which the clear dots having the specific protrusion shape has been formed is observed as a stereo image is supposed to be due to a lens effect which the clear dots exhibit.

In the above, the embodiments of the image formation method of the invention are explained, but the invention is not limited thereto, and may add various modifications thereto.

EXAMPLES

The embodiments of the invention will be explained employing examples, but the invention is by no means limited to these.

[Preparation of Infrared Absorbent Particle Dispersion]

An anionic surfactant, sodium dodecylbenzene sulfonate (SDS) of 90 g was dissolved in 1600 ml of deionized water, and gradually added with 42.0 g of dithiol nickel complex "SIR-130" (manufactured by Mitsui Chemicals) as an infrared absorbent while stirring to prepare a mixture. Subsequently, the resulting mixture was subjected to dispersion treatment using a stirrer CLEAR MIX (manufactured by M Technique Co.) to obtain Infrared Absorbent Particle Dispersion A in which infrared absorbent particles (a) were dispersed. The volume-based median diameter of the infrared absorbent particles (a) dispersed in the Infrared Absorbent Particle Dispersion A was 80 nm, measured by an electrophoretic light scattering spectrophotometer "ELS 800" (manufactured by Otsuka electronics Co., Ltd.)

[Preparation of Transparent Resin Particle Dispersion]

Into a separable flask fitted with a stirrer, a temperature sensor, a condenser and a nitrogen gas-introducing device were introduced an anionic surfactant solution in which 7.0 g of an anionic surfactant sodium dodecylbenzene sulfonate (SDS) is dissolved in 2760 g of deionized water, and heated to 80° C. while stirring at a rate of 230 rpm under nitrogen atmosphere to prepare an aqueous surfactant solution.

Styrene of 125.0 g, 75.0 g of n-butyl acrylate, 50.0 g of methacrylic acid were mixed and heated to 80° C. to obtain a monomer solution.

The aqueous surfactant solution and the monomer solution obtained above were mixed and dispersed in a mechanical disperser CLEARMIX (produced by M Technique Co.) having a circulation path. Thus, an emulsified particle dispersion containing emulsified particles with a uniform particle size was prepared. Subsequently, a polymerization initiator solution, in which 0.84 g of a polymerization initiator (potassium persulfate KPS) were dissolved in 200 g of deionized water, was added to the foregoing emulsified particle dispersion, heated at 80° C. for 3 hours to undergo polymerization, and cooled to 40° C. to obtain a Transparent Resin Particle Dispersion B in which transparent resin particles (b) were dispersed.

[Preparation of Clear Toner]

(1) Formation of Core

The following composition was introduced into a 5 liter four necked flask fitted with a stirrer, a temperature sensor, a condenser and a nitrogen gas introducing device, and stirred.

| | |
|---|---|
| Infrared Absorbent Particle Dispersion A | 125 g |
| Transparent Resin Particle Dispersion B | 1250 g |
| Deionized water | 2000 g |

The resulting mixture was adjusted to 30° C. and added with an aqueous 5N sodium hydroxide solution to give a pH of 10.

Subsequently, an aqueous solution in which 35 g of magnesium chloride were dissolved in 35 ml of deionized water was added thereto at 30° C. in 10 minutes with stirring. After allowed to stand for 3 minutes, the mixture was heated to 90° C. in 60 minutes to perform association of particles. Using Coulter Multisizer III (produced by Beckman Coulter Co.), the particle size of the associated particles in the mixture was measured, and when the associated particles reached a volume-based median diameter of 5.5 μm the mixture was added with an aqueous sodium chloride solution in which 150 g of sodium chloride were dissolved in 600 ml of deionized water to terminate growth of the particles. The resulting mixture was allowed to continue fusion while stirring at 98° C. for 3 hours for ripening treatment to prepare clear toner base particles, cooled to 30° C., added with a hydrochloric acid solution to adjust to a pH of 2. Thereafter, the stiffing being terminated, and the resulting mixture solution was subjected to solid/liquid separation processing through a basket type centrifugal separator, MARK III Type 60×40 (manufactured by Matsumoto Machine Co., Ltd.) to prepare a wet cake of clear toner base particles. This wet cake was repeatedly washed with 45° C. deionized water employing the aforementioned basket type centrifugal separator until the electric conductivity of the filtrate was 5 μS/cm, then placed into the Flash Jet Dryer (manufactured by Seishin Kigyo Co., Ltd.), and dried until the residual amount of water was reduced to 0.5% by weight. Thus, Clear Toner Base Particles 1 were obtained. The average circularity of Clear Toner Base Particles 1 was 0.950, measured by FPIA 2100 (produced by SISMECS Co. Ltd.). Clear Toner Base Particles 1 had a softening temperature of 41° C., a volume-based median diameter of 6.0 μm, a number average molecular weight of 4,800, and a glass transition temperature of 41° C.

Hydrophobic silica (having a number average primary particle size of 12 nm) in an amount of 1% by weight and hydrophobic titanium oxide (having a number average primary particle size of 20 nm) in an amount of 0.3% by weight were added to Clear Toner Base Particles 1 obtained above, and mixed in a Henschel mixer (product by Mitsui Miike Kakoki Co., Ltd.). Thereafter, coarse particles were removed from the mixture using a sieve having a 45 μm opening to obtain Clear Toner 1. The shape or particle diameter of was not changed by addition of the clear toner particles constituting the Clear Toner 1 was not changed by addition of the Hydrophobic silica and hydrophobic titanium oxide.

<Preparation of Clear Developer>

The Clear Toner 1 obtained above was mixed with an acryl resin-covered ferrite carrier having a volume based median diameter of 100 μm to give a clear toner concentration of 6% by weight. Thus, Clear Developer 1 was prepared.

Example 1

Employing a stereoscopic imaging system, a continuous paper full color printer CP 1275C (manufactured by Toppan Forms Co. Ltd.) loaded with the Clear Developer 1 obtained above, a printed matter sample for test (inventive printed matter sample 1) was prepared in which clear dots having a degree of protrusion H/R of 1.2 were formed on the entire surface on an image side of a plain A4 size paper sheet with an image having a 75° glossiness of 35 formed in advance. The resulting printed matter sample for test was visually observed for sensory testing by five arbitrarily selected observers. Both clearness and stereoscopic appearance of the image in the printed matter sample were evaluated in terms of the criterion, which the most observers selected from among the following evaluation criteria. In the evaluation of both clearness and stereoscopic appearance, the criteria A and B were evaluated as acceptable, while the criteria C and D as unacceptable.

Evaluation Criteria (Clearness)

A: The image is observed to be clear.

B: The image is observed somewhat blurred, but is sufficiently discernible, which is non-problematic for practical use.

C: The image is observed blurred, is partly indiscernible, and is considered unacceptable.

D: The image is observed blurred, is totally indiscernible, and is considered unacceptable.

(Stereoscopic Appearance)

A: The image is visually observed as having an excellent stereoscopic appearance.

B: The image is visually observed as having a passable stereoscopic appearance, which is non-problematic for practical use.

C: The image is visually observed as having a slight stereoscopic appearance, and is considered unacceptable.

D: The image is visually observed as having no stereoscopic appearance.

Comparative Example 1

Comparative printed matter sample 1 for test (Comparative sample 1) was prepared in the same manner as in Example 1, except that an image having a 75° glossiness of 8 was used instead of the image having a 75° glossiness of 35, and evaluated in the same manner as in Example 1.

Comparative Example 2

Comparative printed matter sample 2 for test (Comparative sample 2) was prepared in the same manner as in Example 1, except that an image having a 75° glossiness of 65 was used instead of the image having a 75° glossiness of 35, and evaluated in the same manner as in Example 1.

Comparative Example 3

Comparative printed matter sample 3 for test (Comparative sample 3) was prepared in the same manner as in Example 1, except that clear dots having a degree of protrusion H/R of 12 were formed on the entire surface on an image side of an A4 size plain paper sheet with an image having a 75° glossiness of 35 formed in advance instead of the clear dots having a degree of protrusion H/R of 1.2, and evaluated in the same manner as in Example 1.

Comparative Example 4

Comparative printed matter sample 4 for test (Comparative sample 4) was prepared in the same manner as in Example 1, except that clear dots having a degree of protrusion H/R of 0.003 were formed on the entire surface on an image side of an A4 size plain paper sheet with an image having a 75° glossiness of 35 formed in advance instead of the clear dots having a degree of protrusion H/R of 1.2, and evaluated in the same manner as in Example 1.

The results are shown in Table 1.

TABLE 1

| Sample No. | 75° Glossiness | Degree of Protrusion | Evaluation Results: Clearness | Evaluation Results: Stereoscopic Appearance |
|---|---|---|---|---|
| Inventive Sample 1 | 35 | 1.2 | A | A |
| Comparative Sample 1 | 8 | 1.2 | D | B |
| Comparative Sample 2 | 65 | 1.2 | B | D |
| Comparative Sample 3 | 35 | 12 | D | B |
| Comparative Sample 4 | 35 | 0.003 | A | D |

As is apparent from Table 1, only the inventive sample 1 exhibits both excellent clearness and excellent stereoscopic appearance, while comparative samples 1 through 4 exhibit an unacceptable result in either clearness or stereoscopic appearance.

What is claimed is:

1. An image formation method in which clear dots comprised of clear toner are formed on an image with a 75° glossiness of from 10 to 60, the image formation method comprising the steps of:

forming a clear toner image on the image, employing clear toner; and fixing the clear toner image by non-contact heat fixation to form clear dots in the form of protrusions, wherein the clear dots have an average height H and an average circle equivalent diameter R, a ratio H/R of the average height H to the average circle equivalent diameter R satisfying the following inequality:

$$0.005 \leq H/R \leq 10.$$

2. The image formation method of claim 1, wherein the average circle equivalent diameter R of the clear dots is from 10 μm to 2 mm.

3. The image formation method of claim 1, wherein the average height H of the clear dots is from 10 to 100 μm.

4. The image formation method of claim 1, wherein the non-contact heat fixation for forming the clear dots is flash fixation.

5. The image formation method of claim 1, wherein the clear toner constituting the clear dots is composed of clear toner particles containing an infrared absorbent.

6. The image formation method of claim 5, wherein the number average primary particle diameter of the infrared absorbent is from 60 to 1000 nm.

7. The image formation method of claim 5, wherein the infrared absorbent content of the clear toner particles is from 0.1 to 3% by weight.

8. The image formation method of claim 1, wherein the clear toner has a softening point of from 80 to 120° C.

9. The image formation method of claim 1, wherein the image is formed according to an electrophotographic process.

10. The image formation method of claim 1, wherein the clear toner image is formed according to an electrophotographic process.

11. An image formation method according to an electrophotographic process in which clear dots comprised of clear toner are formed on an image with a 75° glossiness of from 10 to 60, the image formation method comprising the steps of:

forming the image with a 75 glossiness of from 10 to 60 on an image recording medium;

forming a clear toner image on the image, employing clear toner; and fixing the clear toner image by non-contact heat fixation to form clear dots in the form of protrusions, wherein the clear dots have an average height H and an average circle equivalent diameter R, a ratio H/R of the average height H to the average circle equivalent diameter R satisfying the following inequality:

$$0.005 \leqq H/R \leqq 10.$$

* * * * *